US005963759A

United States Patent [19]

Kojima et al.

[11] Patent Number: 5,963,759

[45] Date of Patent: Oct. 5, 1999

[54] PROCESS CARTRIDGE AND IMAGE FORMING APPARATUS TO WHICH PROCESS CARTRIDGE CAN DETACHABLY BE MOUNTED

[75] Inventors: Hisayoshi Kojima, Mishima; Akiyoshi Fujita, Numazu, both of Japan

[73] Assignee: Canon Kabushiki Kaisha, Tokyo, Japan

[21] Appl. No.: 08/902,272

[22] Filed: Jul. 29, 1997

[30] Foreign Application Priority Data

Jul. 31, 1996 [JP] Japan ..... 8-217934

[51] Int. Cl.[6] ..... G03G 21/16

[52] U.S. Cl. ..... 399/111; 399/24; 399/25

[58] Field of Search ..... 399/24–27, 111, 399/113, 125, 13

[56] References Cited

U.S. PATENT DOCUMENTS

| | | | |
|---|---|---|---|
| Re. 35,751 | 3/1998 | Midgley | 399/25 |
| 4,839,691 | 6/1989 | Tagawa et al. | 399/12 |
| 4,873,549 | 10/1989 | Tada et al. | 399/25 |
| 4,961,088 | 10/1990 | Gilliland et al. | 399/25 |
| 4,996,566 | 2/1991 | Morita et al. | 399/111 |
| 5,249,026 | 9/1993 | Kojima . | |
| 5,272,503 | 12/1993 | LeSueur et al. | 399/25 |
| 5,283,613 | 2/1994 | Midgley, Sr. | 399/9 |
| 5,452,059 | 9/1995 | Sekiya . | |
| 5,471,284 | 11/1995 | Fujii et al. . | |
| 5,497,220 | 3/1996 | Inomata et al. . | |
| 5,521,693 | 5/1996 | Kojima et al. . | |
| 5,528,344 | 6/1996 | Yamaguchi et al. | 399/13 |
| 5,572,292 | 11/1996 | Chatani et al. . | |
| 5,666,586 | 9/1997 | Nishimura et al. | 399/13 |
| 5,699,091 | 12/1997 | Bullock et al. | 399/113 X |

FOREIGN PATENT DOCUMENTS

| | | |
|---|---|---|
| 0281372 | 9/1988 | European Pat. Off. . |
| 0302415 | 2/1989 | European Pat. Off. . |
| 0532308A2 | 3/1993 | European Pat. Off. . |
| 0623858A1 | 11/1994 | European Pat. Off. . |
| 06067484 | 11/1994 | Japan . |
| 8-160680 | 6/1996 | Japan . |
| 8-185094 | 7/1996 | Japan . |
| 9-190144 | 7/1997 | Japan . |

*Primary Examiner*—Matthew S. Smith
*Attorney, Agent, or Firm*—Fitzpatrick, Cella, Harper & Scinto

[57] ABSTRACT

A process cartridge detachably mountable to an image forming apparatus, includes an electrophotographic photosensitive member, a process device acting on the electrophotographic photosensitive member, and a memory for transmitting information regarding at least the process means to the image forming apparatus. The memory means is attached to a front end face of the process cartridge into the image forming apparatus to be connected to a connector member of the image forming apparatus.

17 Claims, 9 Drawing Sheets

PROCESS CARTRIDGE AND IMAGE FORMING APPARATUS TO WHICH PROCESS CARTRIDGE CAN DETACHABLY BE MOUNTED

BACKGROUND OF THE INVENTION

1. Field of the Invention

The present invention relates to a process cartridge and an electrophotographic image forming apparatus to which such a process cartridge can detachably be mounted. Such an "electrophotographic image forming apparatus" may include, for example, an electrophotographic copying machine, an electrophotographic printer (such as a laser beam printer, LED printer and the like), an electrophotographic facsimile and an electrophotographic word processor. The "process cartridge" may incorporate therein an electrophotographic photosensitive member, and a charge means, a developing means or a cleaning means as a cartridge unit which can removably be mounted on an image forming apparatus; may incorporate therein an electrophotographic photosensitive member, and at least one of a charge means, a developing means and a cleaning means as a cartridge unit which can removably be mounted on an image forming apparatus; or may incorporate therein an electrophotographic photosensitive member and at least a developing means as a cartridge unit which can removably be mounted on an image forming apparatus.

2. Related Background Art

In conventional image forming apparatuses using An electrophotographic image forming process, an electrophotographic photosensitive member and process means acting on the electrophotographic photosensitive member are integrally incorporated as a process cartridge which can detachably be mounted to the image forming apparatus. By using such a process cartridge, since the maintenance of the apparatus can be performed by an operator himself without the need for any expert, operability is improved considerably. Thus, the process cartridge has widely been used in image forming apparatuses.

Now, an example of a conventional image forming apparatus (color laser printer) will be described with reference to FIG. 12.

A first charger is constituted by a charge roller 104*b* which is urged against an image bearing member 104*a* and to which voltage is to be applied and serves to uniformly charge a surface of the image bearing member 104*a* prior to image formation. The exposure to the image bearing member 104*a* is performed by a scanner portion 110 having a laser diode. The laser diode emits laser light in response to an image signal, and the emitted laser light illuminates on a polygon mirror 110*a*. The laser light reflected from the polygon mirror 110*a,* which is rotated at a high speed, scans the image bearing member 104*a* in a generatrix direction thereof. The laser light is collected on the surface of the image bearing member 104*a* through a focusing lens 110*b* and a reflection mirror 110*c*. The surface of the image bearing member (photosensitive drum) 104*a* is exposed by the laser light corresponding to the image signal, to thereby form a latent image for each color component.

A rotating developing means 105 includes a plurality of developing devices 105M, 105C, 105Y and 105K containing therein magenta color toner, cyan color toner, yellow color toner and black color toner, respectively, which developing devices are rotatably disposed with respect to a shaft 105*e*. The center of each developing device is rotated synchronously with a rotating gear disposed around a resolving gear, to thereby maintain the posture of the developing device constant. Four developing devices contain the same amount of toners to make the torque distribution to the shaft 105*e* uniform. In this example, each developing device contains a sufficient amount of toner to print 3000 A3 size sheets can be printed.

During image formation, the developing device 105M (105C, 105Y and 105K) corresponding to the color component of the latent image is brought to be opposed to the image bearing member 104*a*. At that position, a developing roller 105*b* of the developing device is positioned in a confronting relation to the image bearing member 104*a* with a small gap. When the developing device 105M (105C, 105Y and 105K) is shifted to the developing position, the developing roller 105*b* is connected to a high voltage source of the apparatus so that a developing bias is applied to the developing roller. At the same time, the developing roller is connected to a drive means from a drive source of the apparatus.

By applying the developing bias and the rotational force to the developing roller 105*b* in this way, the latent image on the image bearing member 104*a* is developed, to thereby form a toner image.

On the other hand, a sheet supply portion 101 disposed within the apparatus at a lower part thereof serves to supply a transfer material 102 to a transfer drum 103. The transfer materials 102 are housed in a sheet supply cassette 101*a*. In response to image formation, a sheet supply roller 101*b* is rotated to pick up the transfer material 102 from the sheet supply cassette 101*a*, and the picked-up transfer material is supplied to the transfer drum 103.

The transfer material 102 supplied from the sheet supply portion 101 is wound around the transfer drum 103. An electrostatic absorption roller 103*g* is disposed around the transfer drum 103 to be contacted with and separated from the transfer drum. The electrostatic absorption roller 103*g* is urged against the transfer drum to pinch the transfer material 102 between the absorption roller and the transfer drum. In this case, by applying a bias between the electrostatic absorption roller 103*g* and the transfer drum 103, the transfer material 102 is electrostatically adhered to the peripheral surface of the transfer drum 103.

The color toner image formed on the image bearing member 104*a* is transferred onto the transfer material 102 at the transfer drum 103.

When the transferrring of the magenta toner image is completed, the next developing device 105C is rotated to be brought to the developing position where the developing device is opposed to the image bearing member 104*a*. By repeating a similar process, the cyan toner image, the yellow toner image and the black toner image are successively transferred onto the same transfer material 102, to thereby form a full-color image. By rotating the transfer drum 103 bearing the transfer material 102 thereon by four revolutions, a full-color image print can be obtained.

A cleaner 104C serves to remove residual toner remaining on the image bearing member 104*a* and is disposed around the image bearing member 104*a* at a downstream side of the transfer portion.

The transfer material to which four color toner images were transferred is separated from the transfer drum 103, and the separated transfer material is conveyed to a fixing portion 106. The fixing portion 106 includes a pressure roller 106*a*, and a fixing roller 106*b* urged against the pressure roller to apply heat and pressure to the transfer material. While the transfer material is being passed through the fixing portion 106, the color toner images are fixed to the transfer material 102.

After the toner images were fixed to the transfer material at the fixing portion 106, the transfer material is discharged onto a discharge tray 108 by means of a pair of discharge rollers 107.

As mentioned above, in recent years, the image bearing member, the cleaner, the first charger, the developing means and a waste toner box are integrally incorporated into a cartridge which can be detachably mounted to the image forming apparatus. Thus, since the operator himself can mount and dismount the process cartridge with respect to the image forming apparatus, if the toner in the cartridge is completely consumed or if any part of the cartridge reaches its service life, the cartridge can be exchanged for a new cartridge by the operator himself, to thereby facilitate maintenance.

When the service life of the image bearing member is extended and the number of prints is increased, as is in the example shown in FIG. 12, in order to use the developing means, which as the limited toner supplying ability as an independent unit, the process cartridge is divided into a developing cartridge only including the developing means and a drum cartridge unit 104 including the image bearing member 104*a*, first charger 104*b* and cleaner 104*c*, both cartridges being detachably mountable to the image forming apparatus. In this case, the mounting or dismounting of the cartridges and the maintenance of the cartridge can be facilitated, and the cartridges can be used independent from the service lives of the main part thereof (toner consumption or expiration of service life of the part). In such a drum cartridge, the waste toner collected by the cleaner is accumulated in a cleaning container having a volume exceeding the service life of the image bearing member, and, thus, the cleaning container is not filled with the waste toner before the service life of the image bearing member is expired. When the service life of the image bearing member is expired, the drum cartridge is exchanged to a new one.

In the drum cartridge, in order to improve the operability for the operator, i.e., in order to permit exchanging of the other parts or unit such as the developing cartridge along one direction, the drum cartridge is generally mounted on and dismounted from the image forming apparatus along an axial direction.

However, in the above-mentioned conventional drum cartridge, in order to further improve image quality and to further extend the service life, it is required that detailed information regarding the image bearing member and other process units (for example, the difference in feature due to dispersion between the manufacturing accuracy of process units) is supplied to the image forming apparatus to obtain the proper electrophotographic process condition. To this end, recently, there has been proposed a technique in which a memory means (recording medium) is mounted on the cartridge and various information data are stored in the memory means to be supplied to the image forming apparatus through the communication between the cartridge and the image forming apparatus.

In such a cartridge, the memory means and a connector member for connecting the memory means to the image forming apparatus must be mounted at the proper positions in consideration of the inserting direction of the cartridge into the image forming apparatus. On the other hand, in the image forming apparatus and the cartridge used in such an image forming apparatus, in order to mount and dismount the cartridge along the axial direction or longitudinal direction, for example, when the cartridge is exchanged by the operator, it is important to stabilize the holding of the cartridge.

SUMMARY OF THE INVENTION

Accordingly, a main object of the present invention is to provide a process cartridge in which a memory means is mounted so as to be surely connected to an image forming apparatus stably, and an image forming apparatus having such a process cartridge.

Another object of the present invention is to provide a process cartridge which has excellent operability and exchangeability, and an image forming apparatus having such a process cartridge.

DETAILED DESCRIPTION OF THE PREFERRED EMBODIMENTS

Now, an image forming apparatus and a process cartridge according to the present invention will be fully explained with reference to the accompanying drawings.

(First Embodiment)

First of all, a first embodiment of the present invention will be explained with reference to FIGS. 1 to 8 and FIG. 11.

[Explanation of Entire Image Forming Apparatus]

Figure 11:
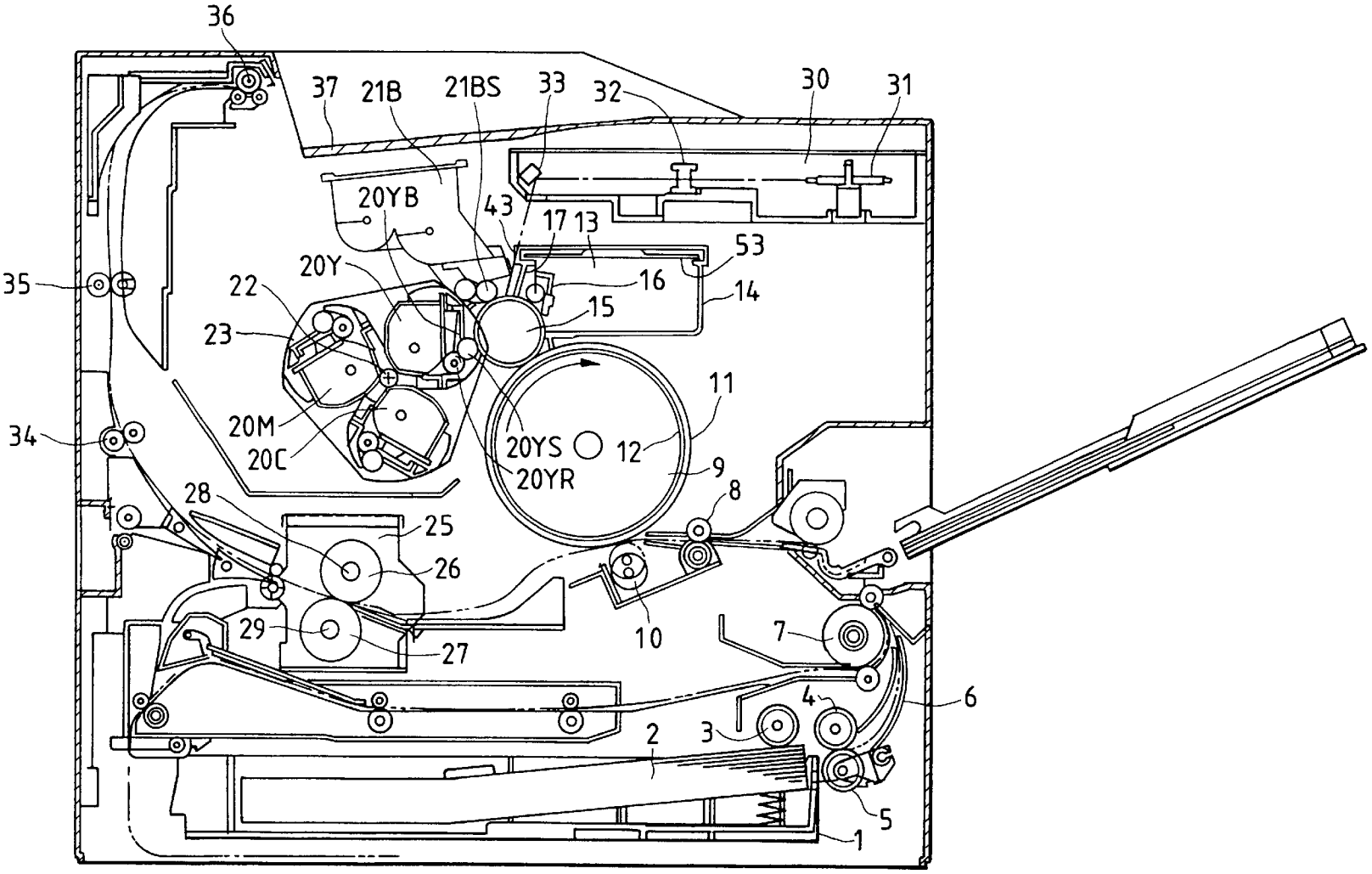
FIG. 11 is an elevational sectional view of an image forming apparatus according to the present invention.
Figure 12:
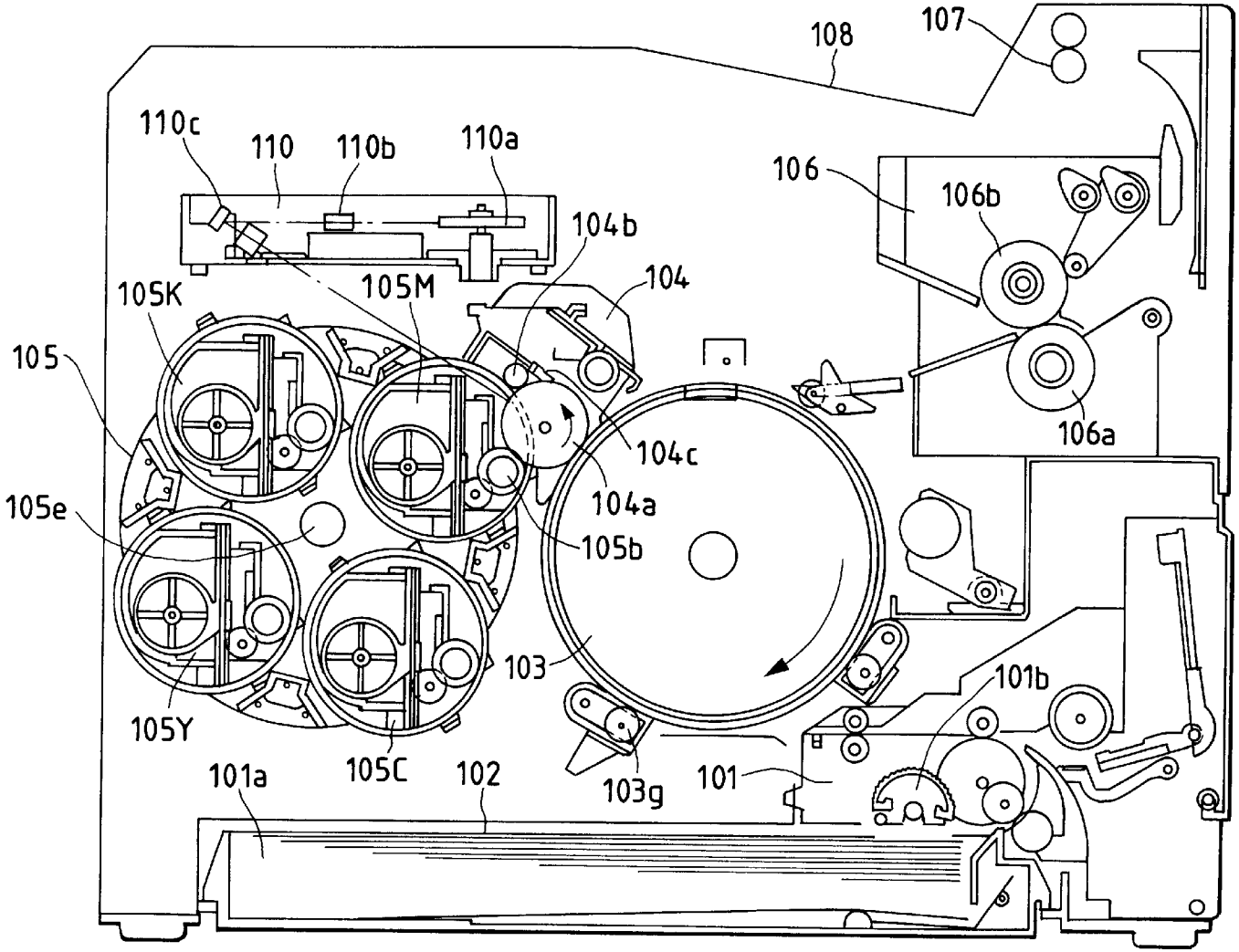
FIG. 12 is an elevational sectional view of a conventional image forming apparatus.

The entire construction of a color image forming apparatus will be briefly explained with reference to FIG. 11 showing a color laser printer as an example of the color image forming apparatus.

An image forming portion of the color laser printer includes an image bearing member (electrophotographic photosensitive member) 15 rotated at a constant speed, a fixed black developing device 21B, and three rotatable color developing devices (yellow developing device 20Y, magenta developing device 20M and cyan developing device 20C). A transfer material 2 which is supplied from a sheet supply portion and to which color toner images were transferred in a superimposed fashion in an image forming portion is conveyed to a fixing device 25, where the toner images are fixed to the transfer material as a full-color image. Thereafter, the transfer material is discharged onto a discharge portion 37 formed on an upper surface of the printer by pairs of convey rollers 34, 35 and a pair of discharge rollers 36. The rotatable color developing devices and the fixed black developing device can be detachably mounted to the printer.

Next, parts of the image forming apparatus will be explained in order.

[Image Bearing Member Unit]

A drum unit (image bearing member unit) 13 includes an image bearing member (electrophotographic photosensitive member) 15, a first charge means 17, and a container 14 of a cleaning device acting as a holder for the image bearing member, which are integrally formed as a unit. The drum unit 13 can be detachably mounted to the printer body so that the unit can easily be exchanged (by a new one) when the service life of the image bearing member 15 is expired.

In the illustrated embodiment, the image bearing member 15 is constituted by an aluminium cylinder having a diameter of 62 mm and an organic photoconductive layer coated on the aluminium cylinder and is rotatably supported by the container 14 of the cleaning device 16. Around the image bearing member 15, there are disposed a cleaning blade 16 and the first charge means 17. The image bearing member 15 is rotated in a counter-clockwise direction in synchronism with the image forming operation by transmitting a driving force of a drive motor (not shown) to one end of the image bearing member.

[Charge Means]

The first charge means 17 is of contact charging type and comprises a conductive charge roller urged against the image bearing member 15 so that the surface of the image bearing member 15 is uniformly charged by applying voltage to the charge roller.

[Exposure Means]

The exposure to the image bearing member 15 is performed by a scanner portion 30. More specifically, when an image signal is sent to a laser diode, the laser diode emits image light corresponding to the image signal onto a polygon mirror 31. The polygon mirror 31 is rotated at a high speed by a scanner motor 31*a*, so that the image light reflected from the polygon mirror 31 selectively exposes the surface of the image bearing member 15 (rotated at a constant speed) through a focusing lens 32 and a reflection mirror 33, to thereby form an electrostatic latent image on the image bearing member 15.

[Developing Means]

The developing means includes three rotatable color developing devices 20Y, 20M and 20C containing yellow color toner, magenta color toner and cyan color toner, and a black developing device 21B containing black toner to visualize the electrostatic latent image. The black developing device 21B is a fixed developing device and contains an amount of toner capable of obtaining 12000 pages or prints (A4 size, 5% print). In this fixed black developing device, a developing sleeve 21BS is opposed to the image bearing member with a small gap (about 300 $\mu$m) therebetween to form a black toner image on the image bearing member 15.

Three rotatable developing devices 20Y, 20M and 20C each contains an amount of toner capable of obtaining 6000 pages (A4 size, 5% print) and are detachably mounted on a developing rotary 23 rotated around a shaft 22.

In the image formation, the rotatable developing devices are rotated around the shaft while being held on the developing rotary 23 so that the desired developing device is opposed to the image bearing member 15. Further, after the developing sleeve 21BS is opposed to the image bearing member 15 with the small gap (about 300 $\mu$m) therebetween, the electrostatic latent image on the image bearing member 15 is developed as the toner image. In color image formation, whenever an intermediate transfer member 9 is rotated by one revolution, the developing rotary 23 is rotated, so that the developing processes are performed with the yellow developing device 20Y, magenta developing device 20M, cyan developing device 20C and black developing device 20B in order.

In FIG. 11, when the developing process is performed, for example, the yellow developing device 20Y is opposed to the image bearing member unit 13, and the yellow toner in a container is sent to a coating roller 20YR by a toner feed mechanism. The coating roller 20YR rotated in a clockwise direction and a blade 20YB urged against the developing sleeve 20YS cooperate with each other to form a thin toner layer on the peripheral surface of the developing sleeve 20YS rotated in the clockwise direction and to apply charges (frictional charges) to the toner. By applying a developing bias to the developing sleeve 20YS opposed to the image bearing member 15, the latent image on the image bearing member 15 is developed as a toner image.

Also regarding the magenta developing device 20M and the cyan developing device 20C, toner images can be formed in a similar manner. The developing sleeve of the developing device 20Y, 20M or 20C is connected to a high voltage source and a drive source of the printer when the developing device is brought to the developing position, so that a voltage and a driving force are applied to the developing sleeve.

[Intermediate Transfer Member]

The intermediate transfer member 9 is rotated in the clockwise direction in synchronism with the peripheral speed of the image bearing member 15 to receive the four toner images (yellow image, magenta image, cyan image and black image) (on the image bearing member 15 visualized by the developing devices) in a superimposed fashion four times. The intermediate transfer member 9 to which the superimposed toner images were transferred cooperates with the transfer roller 10 to which the voltage was applied to pinch the transfer material 2 therebetween. While the transfer material is being conveyed between the intermediate transfer member and the transfer roller, the superimposed toner images on the intermediate transfer member are transferred onto the transfer material 2 collectively. The intermediate transfer member 9 is constituted by an aluminium cylinder 12 having a diameter of 186 mm, and an elastic layer 11 made of an intermediate resistance sponge or an intermediate resistance rubber and coated on the aluminium cylinder. The intermediate transfer member 9 is rotatably supported and is rotated by a driving force transmitted to a gear (not shown) secured to the intermediate transfer member.

[Cleaning Means]

The cleaning means serves to remove residual toner remaining on the image bearing member 15 after the toner images (visualized by the developing means) on the image bearing member are transferred to the intermediate transfer member 9. The removed waste toner is accumulated in the cleaner container 14. The amount of the waste toner accumulated in the cleaner container 14 does not fill the container 14 before the service life of the image bearing member 15 is expired. Thus, the cleaner container 14 is exchanged together with the image bearing member 15 when the service life of the image bearing member is expired.

[Sheet Supply Portion]

The sheet supply portion serves to supply the transfer material 2 to the image forming portion. The sheet supply portion includes a cassette containing a plurality of transfer materials, a sheet supply roller 3, a feed roller 4, a double feed preventing retard roller 5, a sheet supply guide 6 and a pair of regist rollers 8.

During image formation, the sheet supply roller 3 is rotated in synchronism with the image forming operation to pick up the single transfer material 2 from the cassette 1, and the picked-up transfer material is supplied to the pair of regist rollers 8 through the sheet supply guide 6 and a convey roller 7. Also during image formation, the pair of regist rollers 8 perform a non-rotating operation for awaiting the transfer material 2 temporarily and a rotation operation for conveying the transfer material 2 toward the intermediate transfer member 9, to thereby effect registration between the toner images and the transfer material 2 in the next transferring process.

[Transfer Portion]

The transfer portion includes the rockable transfer roller 10. The transfer roller 10 is constituted by a metallic shaft and an intermediate resistance foam elastic layer provided around the metallic shaft and can be shifted in an up-and-down direction and is rotatingly driven.

While the four color toner images are being formed on the intermediate transfer member 9, i.e., while the intermediate transfer member 9 is being rotated by several revolutions, the transfer roller 10 is spaced apart from the intermediate transfer member 9 as shown by the solid line in FIG. 11 to prevent distortion of the images. On the other hand, after the four color toner images are formed on the intermediate transfer member 9, in synchronism with the timing for transferring the color toner images to the transfer material 2, the transfer roller 10 is shifted upwardly (to a position shown by the phantom line) by a cam member (not shown) to be urged against the intermediate transfer member 9 with predetermined pressure with the interposition of the transfer material 2. At the same time, by applying transfer bias to the transfer roller 10, the toner images on the intermediate transfer member 9 are transferred onto the transfer material 2.

Since the intermediate transfer member 9 and the transfer roller 10 are driven respectively, the transfer material 2 pinched between these elements is conveyed to the left in FIG. 11 while the transferring process is being performed, and is sent to the fixing portion 25.

[Fixing Portion]

The fixing portion serves to fix the toner images (transferred to the transfer material by transferring the toner images formed by the developing means via the intermediate transfer member 9) to the transfer material 2 and includes a fixing roller 26 for applying heat to the transfer material 2 and a pressure roller 27 for urging the transfer material 2 against the fixing roller 26.

The rollers 26, 27 are hollow rollers having heaters 28, 29 therein and are rotatingly driven to convey the transfer material 2. While the transfer material 2 bearing the toner images is being conveyed between the fixing roller 26 and the pressure roller 27, the toner is fixed to the transfer material 2 by heat and pressure.

Figure 1:
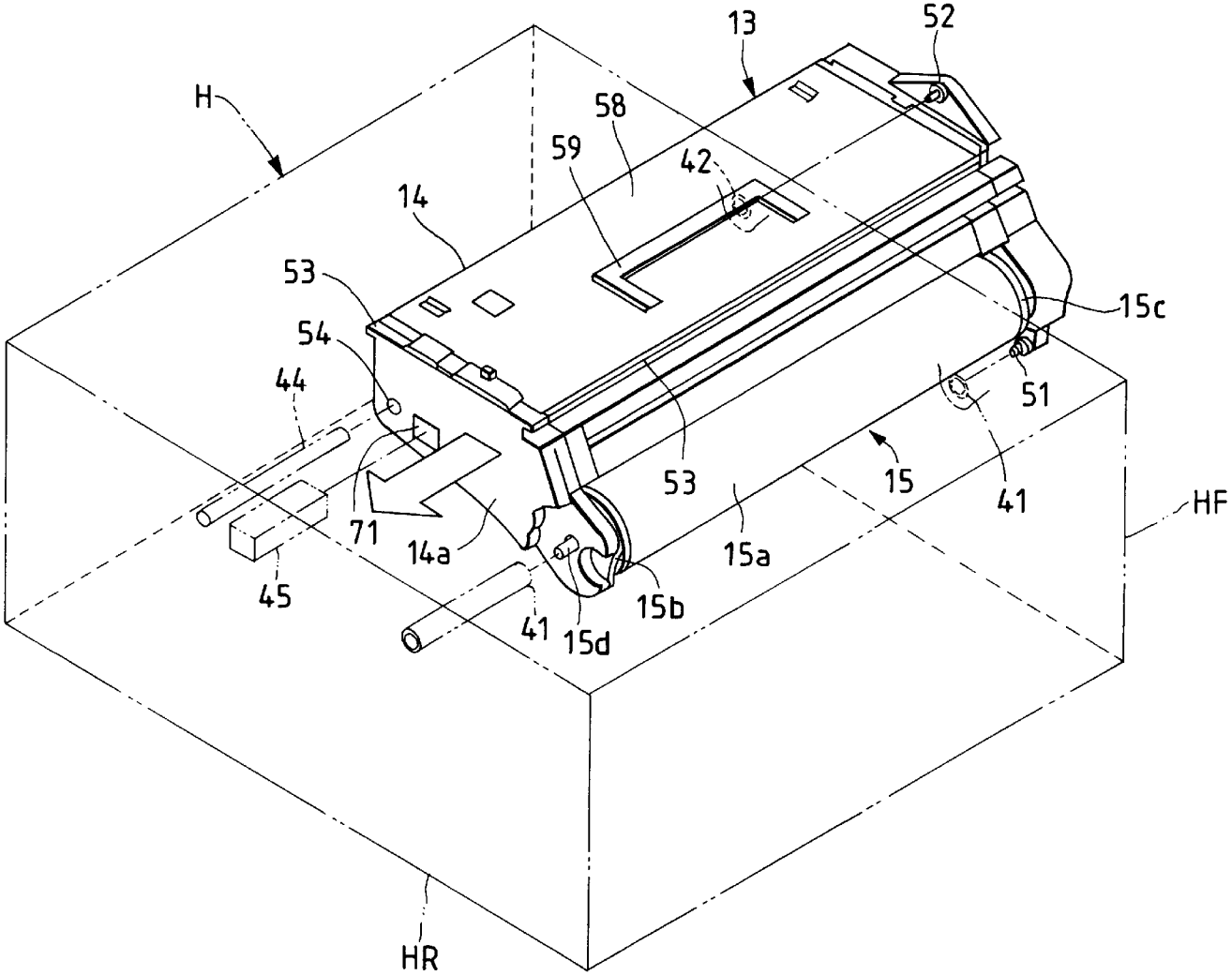
FIG. 1 is a schematic perspective view of a drum cartridge according to a first embodiment of the present invention.

Next, a drum unit (referred to as "drum cartridge" hereinafter) as a process cartridge according to this embodiment will be fully described with reference to FIG. 1.

The image bearing member 15 is constituted by a cylinder portion 15*a* on which the photosensitive layer is coated, and flange portions 15*b*, 15*c* having drum shafts 15*d* firmly secured to both ends of the cylinder portion. The drum shafts 15*d* protrude from side walls 14*a* of the container 14 as a cartridge frame. When the drum cartridge 13 is mounted on the printer H, one of the drum shafts 15*d* is fitted in a coupling member 41 for driving the drum cartridge 13, so that the image bearing member (photosensitive drum) 15 is positioned in a direction perpendicular to the axis of the drum and a driving force can be transmitted to the photosensitive drum. The flange portion 15*c* is rotatably supported by the container 14 via the other drum shaft 15*d*. Positioning pins 51, 52 are formed on the side wall of the container 14 near the flange portion 15*c*. When the positioning pins 51, 52 are fitted into positioning holes 41, 42 formed in a side plate HF of the printer (at the cartridge insertion side), the non-driving side of the photosensitive drum 15 is positioned in a direction perpendicular to the axis of the drum and in an axial direction of the drum.

Regarding the driving side (right in FIG. 1) of the cartridge, as well as the aforementioned connection between the drum shaft 15*d* and the coupling member 41, a positioning mechanism 54 provided on the end face of the container is fitted on a positioning shaft 44 supported by the printer H, to thereby prevent torsion due to a rotational moment force generated when the drum cartridge is driven.

Figure 2:
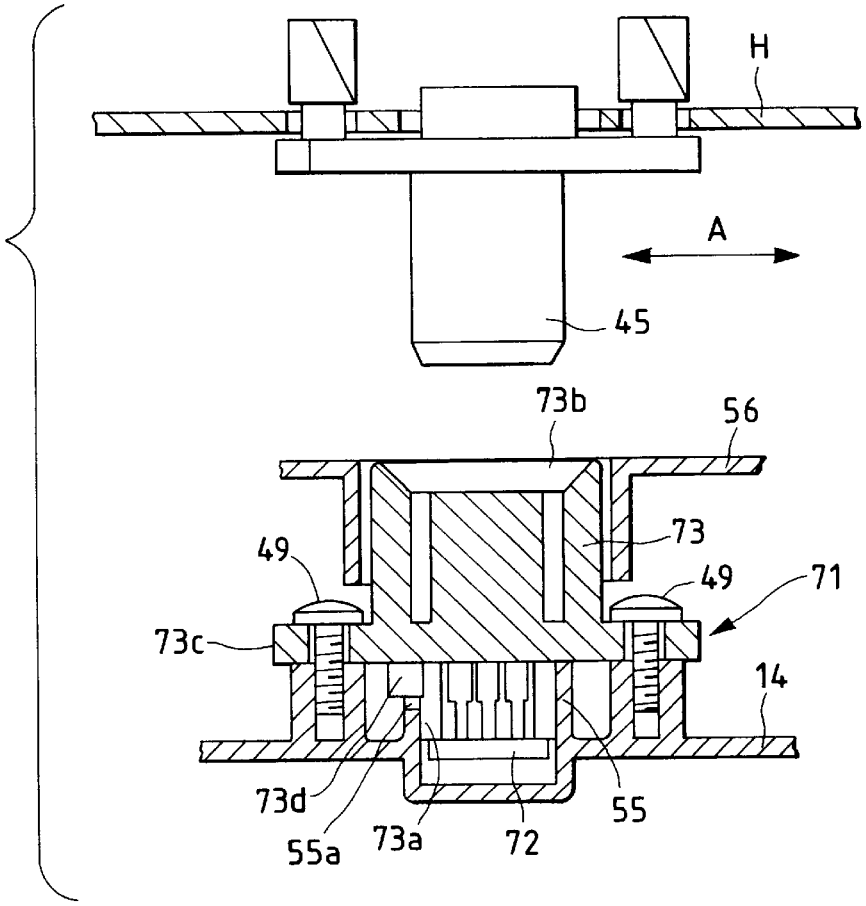
FIG. 2 is an explanatory view showing a memory means of FIG. 1 and a connector of an image forming apparatus.
Figure 3:
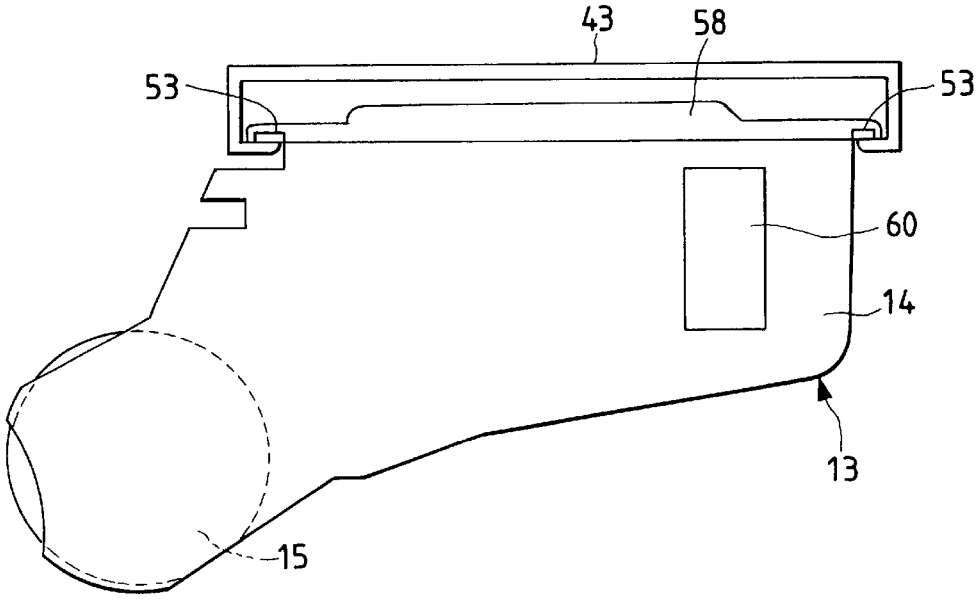
FIG. 3 is a schematic front view of the cartridge of FIG. 1.
Figure 4:
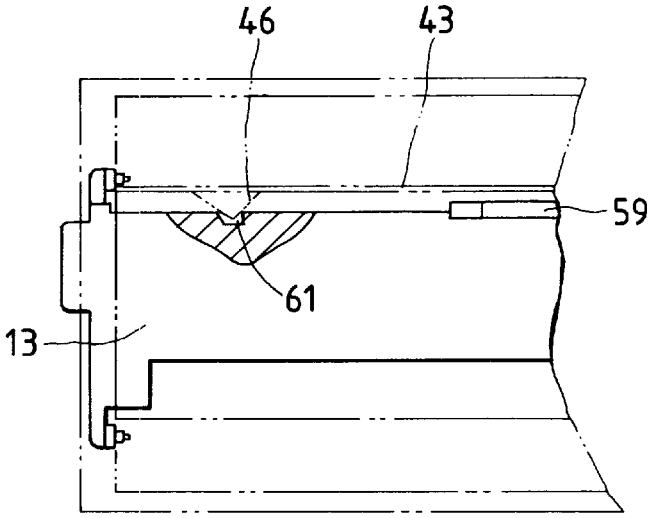
FIG. 4 is an explanatory view showing main portions of the cartridge of FIG. 1 inserted into the image forming apparatus.
Figure 5:
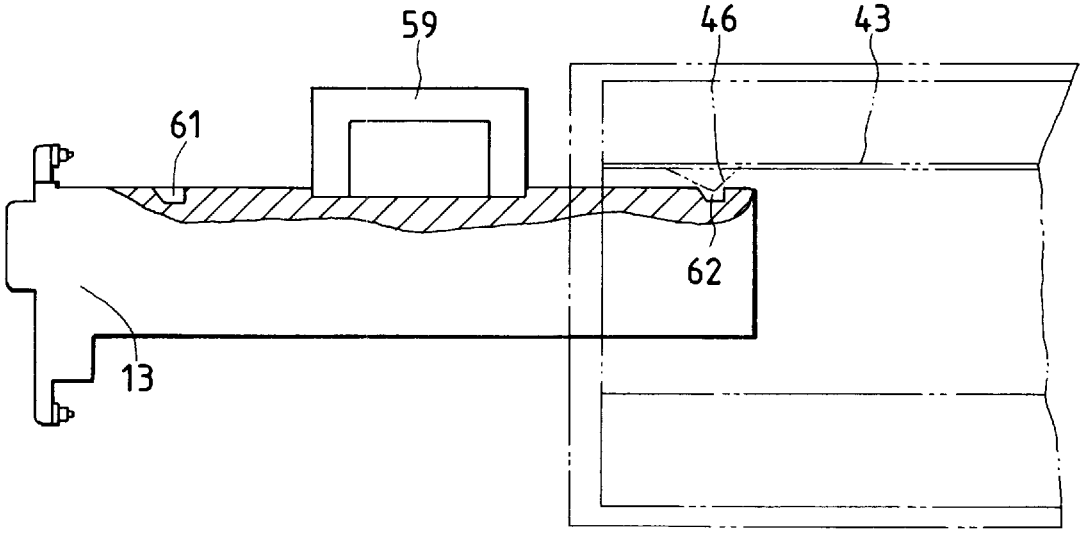
FIG. 5 is an explanatory view showing main portions of the cartridge of FIG. 1 dismounted from the image forming apparatus.

Next, a memory means 71 of the drum cartridge 13 will be explained with reference to FIG. 2. The memory means 71 includes a memory chip 72 such as RAM or ROM in which required information data (for example, the difference in feature due to dispersion between the manufacturing accuracy of image bearing members and other process means) are previously stored. The memory means is used to judge usage conditions of the drum cartridge by effecting communication between the cartridge and the printer during the usage of the drum cartridge.

The memory chip 72 is supported by a connector 73 for effecting connection to the printer. The connector 73 is constituted by a connection portion 73*a* for connecting the connector to the memory chip 72, a connection portion 73*b* for connecting the connector to the printer H, and an attachment surface 73*c* for attaching the connector to the container 14. The connector is secured to a front (cartridge inserting direction) surface of the container 14 by screws 49.

It is desirable that the connector 45 of the printer is supported for shifting movement in a direction perpendicular to the axial direction (shown by the arrow A) by about 0.5 to 2 mm with respect to the printer. With this arrangement, if there is any attachment positional deviation, the connector 45 can surely be connected to the connector 73. Alternatively, the connector 73 of the cartridge may be supported for shifting movement and the connector of the printer may be fixed.

Further, when the container 14 is provided with a rib-shaped wall 55 surrounding the connector portion 73*a* for connecting to the memory chip 72, touching to the memory chip during the assembling or handling can be avoided, to thereby prevent occurrence of electrostatic breakdown. Further, when a projection 73*d* is formed on the connection portion 73*a* and a corresponding notch 55*a* is formed in the rib-shaped wall 55, erroneous assembling can be prevented.

Further, portions of the connector 73 other than the connection portion 73*b* are covered by a cover member so that an outer surface of the cover member 56 does flush with or is not protrude from an end face of the connection portion 73*b*. With this arrangement, for example, even when the operator erroneously sets the container 14 with the memory means 71 facing downwardly or strikes the container against something, the memory means 71 can be prevented from being subjected to a direct load or shock, to thereby protect the memory means 71.

Next, mounting and dismounting of the drum cartridge 13 with respect to the printer will be explained with reference to FIG. 1 and FIGS. 3 to 5.

The drum cartridge 13 is provided at its upper both ends with guide ribs 53 extending in parallel with the image bearing member 15 to guide the drum cartridge in the axial direction (longitudinal direction) with respect to the printer. The guide ribs 53 may be formed directly on the container 14 or may be formed on the interface between the container and a lid member 58 constituting the frame of the cartridge.

The drum cartridge 13 is further provided at its top surface (for example, top surface of the lid member 58) with a first grip portion 59 for enhancing its transportation ability. In the illustrated embodiment, the first grip portion 59 can be laid toward the top surface of the cartridge frame so that, when the cartridge is inserted into the printer, by bringing the lid portion 58 down, space efficiency of the printer can be enhanced. However, the grip portion may be formed directly on the top surface of the cartridge. The drum cartridge 13 is further provided at its rear (inserting direction) end face with a second grip portion 60 for facilitating the retraction of the cartridge when the cartridge is exchanged, to thereby improve the operability.

A guide rail 43 acting as a mounting guide for the drum cartridge 13 is formed on the printer. The drum cartridge 13 is mounted on the printer in such a manner that the guide ribs 53 of the drum cartridge are suspended from the guide rail 43. In the illustrated embodiment, a spring member 46 is attached to the guide rail 43, and the drum cartridge 13 is provided at its top surface with first and second recesses 61, 62 which are disposed at a first position (refer to FIG. 4) where the cartridge is completely inserted into the printer and a second position (refer to FIG. 5) where the first grip portion 59 is completely exposed from the printer, respectively, and are engaged by the spring member 46 at these positions, respectively. With this arrangement, a click feeling upon complete mounting of the drum cartridge 13 to the printer can be obtained, and, when the drum cartridge 13 is dismounted from the printer, since the first grip portion 59 is stopped temporarily at the second position where the operator can grip the first grip portion, the drum cartridge 13 can be prevented from being dropped from the printer and the operability can be improved.

Figure 6:
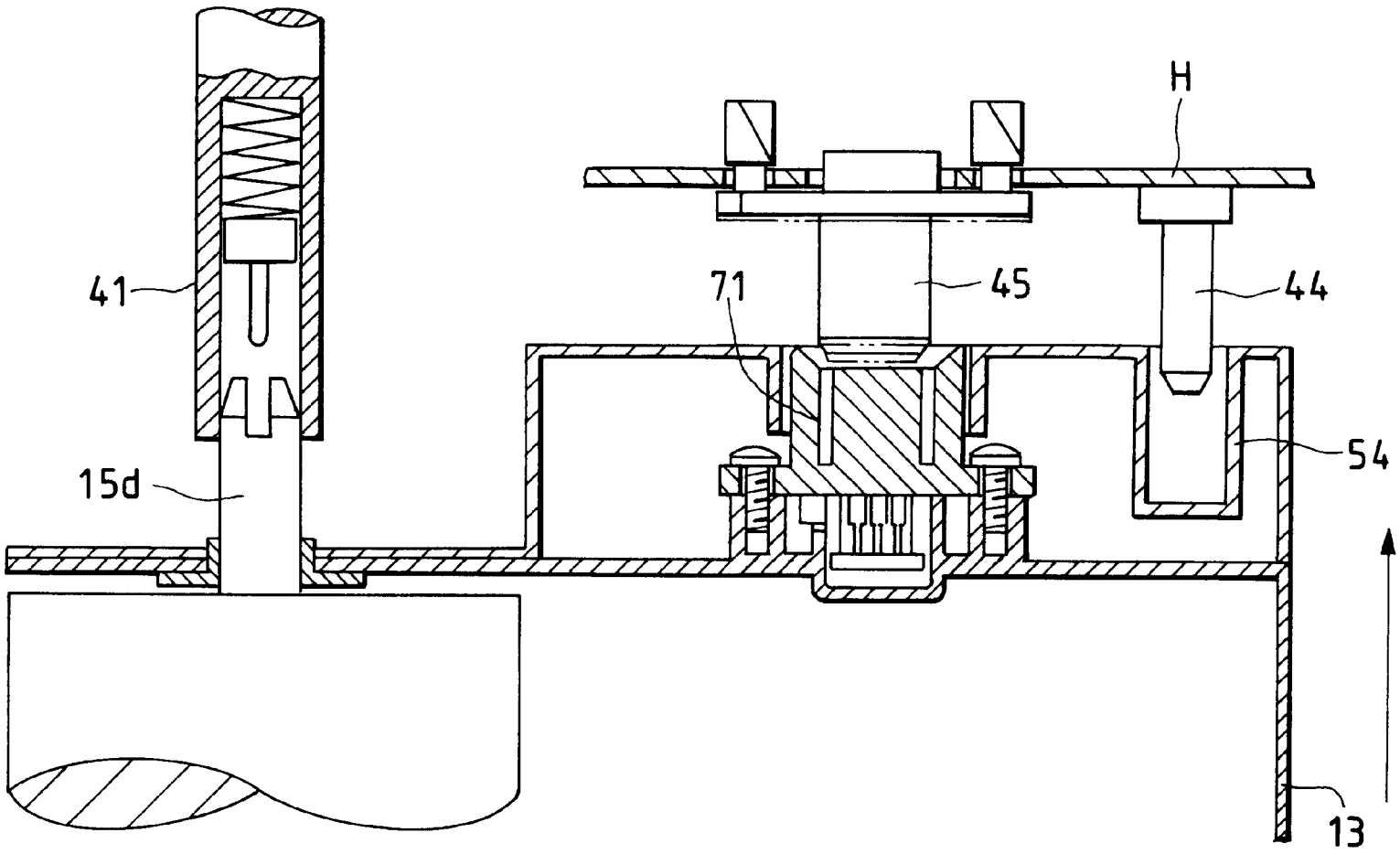
FIG. 6 is an explanatory view showing the memory means of FIG. 1 and the area therearound.
Figure 7:
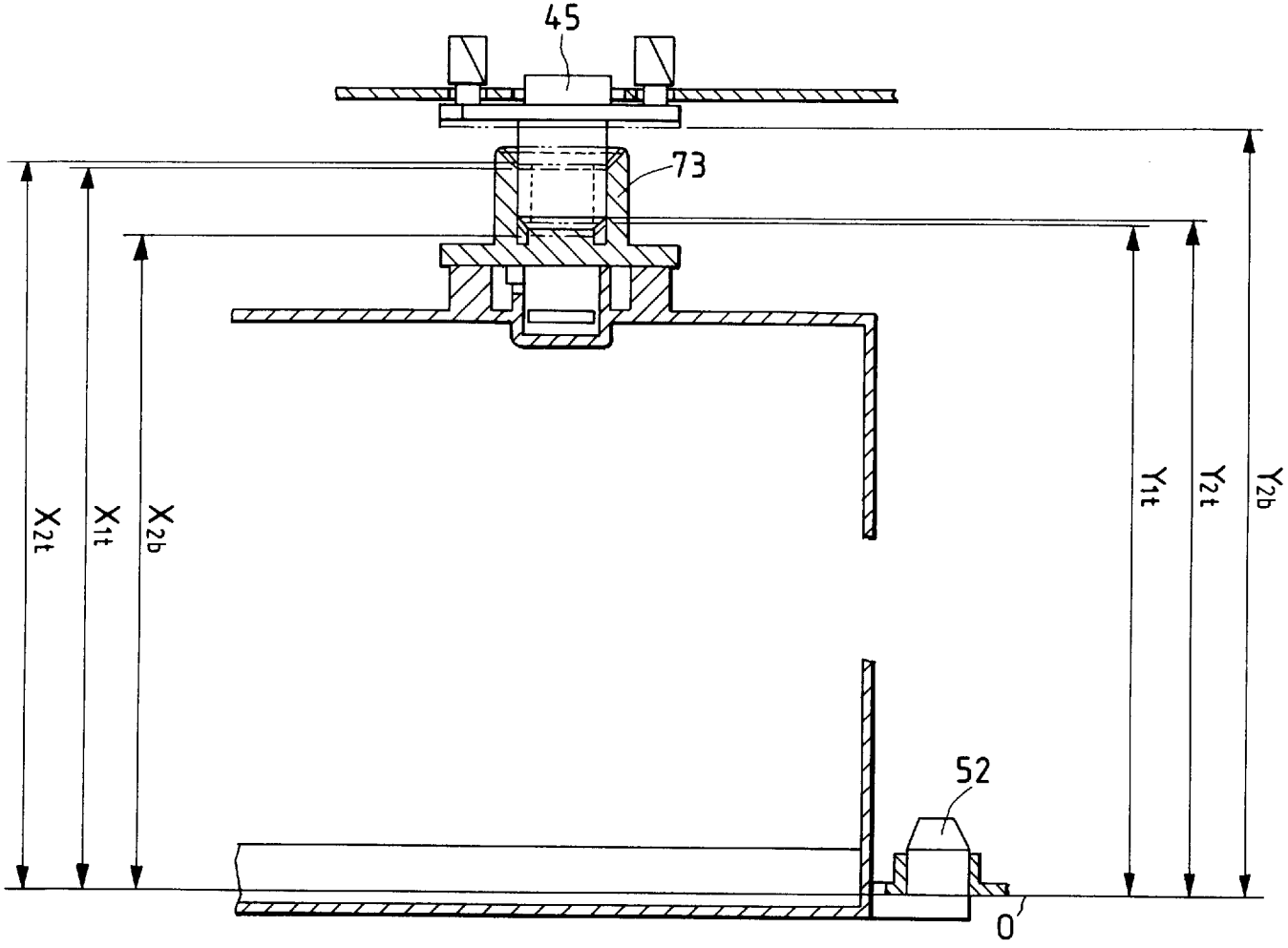
FIG. 7 is an explanatory view showing the positional relation between the memory means of FIG. 1 and the connector of the image forming apparatus.

Next, the position of the memory means 71 will be fully described with reference to FIGS. 6 and 7.

As mentioned above, the memory means 71 is supported on the front (in the inserting direction) end face of the drum cartridge. In this case, the longitudinal position of the memory means is selected so that, after the drum shaft 15*d* and the positioning hole 54 are fitted with respect to the coupling member 41 and the positioning shaft 44 of the printer to determine the posture of the drum cartridge 13 relative to the printer, the memory means 71 is engaged by the connector 45 of the printer.

As already described in connection with FIG. 1, the drum cartridge 13 is positioned in the axial (longitudinal) direction with respect to the printer by fitting the positioning pins 51, 52 into the positioning holes 41, 42 of the printer. Since there is dispersion in the lengths of members forming the cartridge and the printer, the distances between the axial positioning position and both connectors are selected as follows. That is to say, in FIG. 7, it is assumed that a minimum distance from the axial positioning position 0 to an effective fitting tip of the connector 73 of the cartridge is $X_{1t}$, a maximum distance from the axial positioning position 0 to the effective fitting tip of the connector 73 is $X_{2t}$, and a minimum distance from the axial positioning position 0 to an effective fitting root of the connector 73 is $X_{2b}$. Similarly, it is assumed that a minimum distance from the axial positioning position 0 to an effective fitting tip of the connector 45 of the printer is $Y_{1t}$, a maximum distance from the axial positioning position 0 to the effective fitting tip of the connector 45 is $Y_{2t}$, and a minimum distance from the axial positioning position 0 to an effective fitting root of the connector 45 is $Y_{2b}$. In this case, by arranging both connectors 73, 45 to satisfy relations $X_{1t}>Y_{2t}$ and $X_{2t}<Y_{2b}$ and $X_{2b}<Y_{1t}$, even if there is dispersion in the lengths of the members, an excessive or poor connection between the connectors can be prevented.

Figure 8:
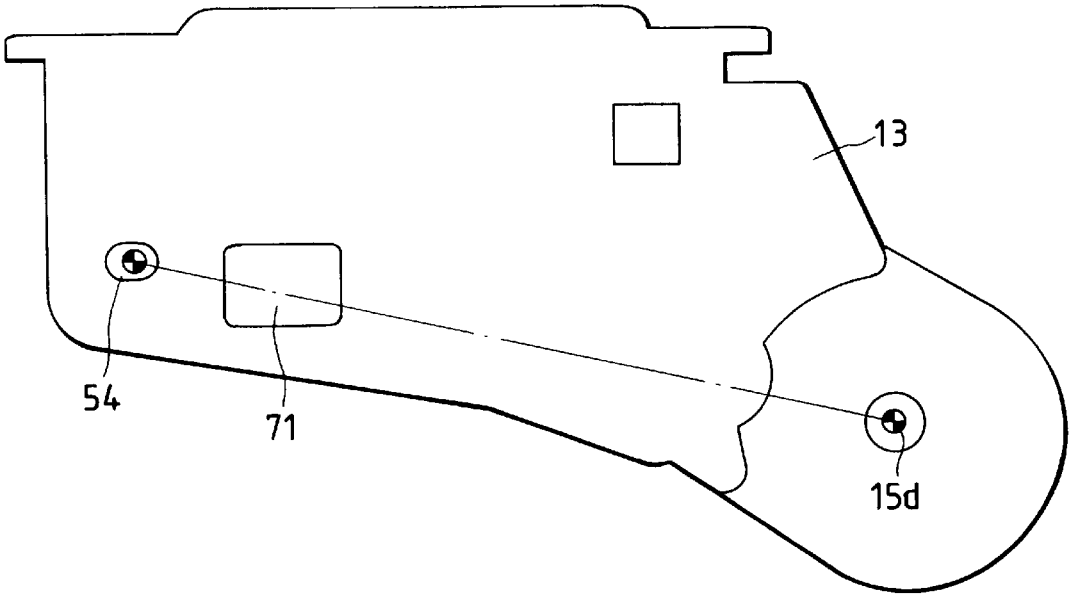
FIG. 8 is an explanatory view showing the position of the memory means of FIG. 1 in a plane direction.

Regarding the position of the memory means in a direction perpendicular to the axial direction, as shown in FIG. 8, the memory means 71 is disposed on a line connecting the drum shaft 15*d* and the positioning hole 54 near the drum shaft or near the positioning hole. By arranging the memory means in this way, the positional deviation between the memory means and the mechanism for determining the posture of the cartridge can be minimized, to thereby prevent the poor connection in the direction perpendicular to the axial direction.

(Second Embodiment)

Next, a second embodiment of the present invention will be explained.

Figure 9:
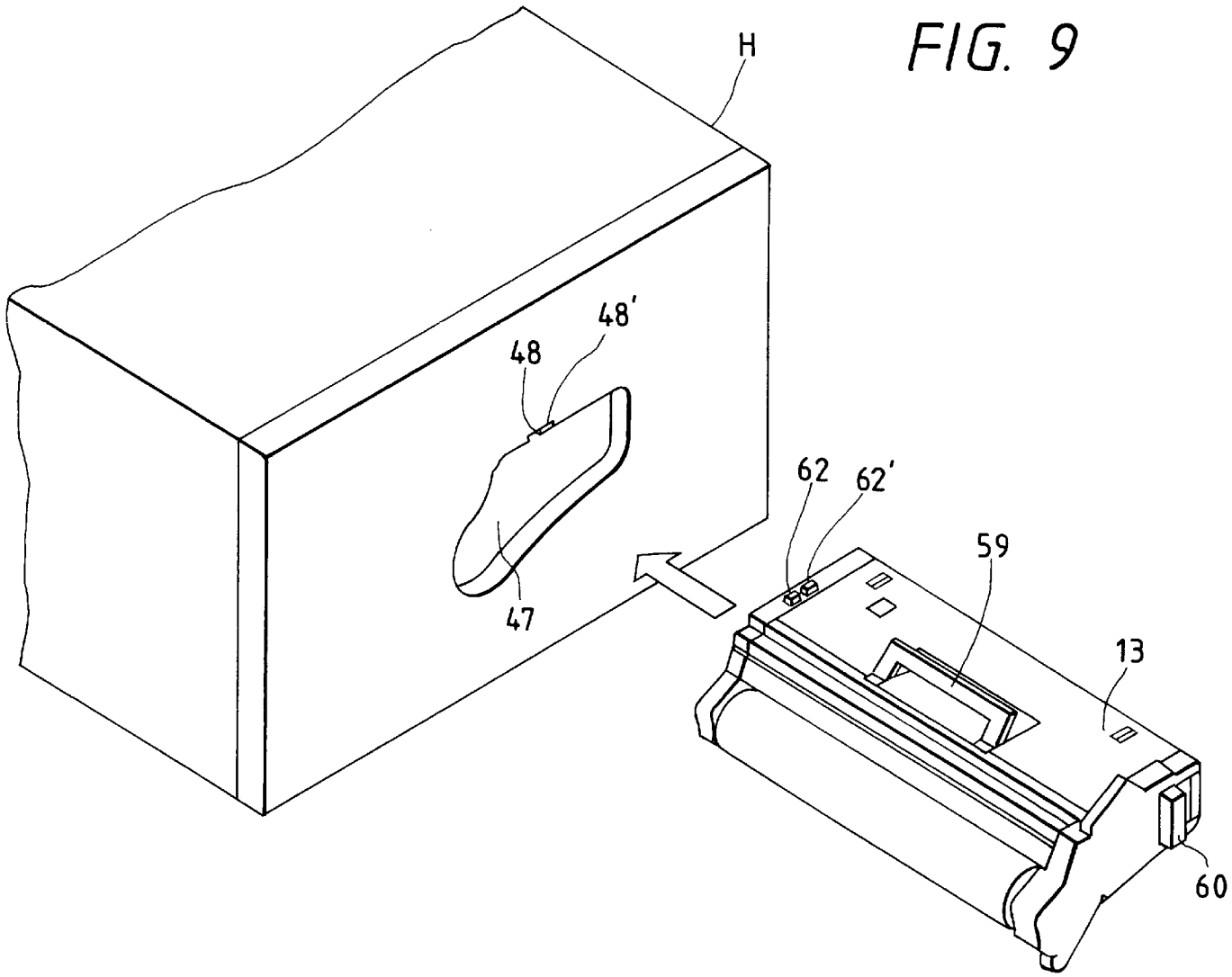
FIG. 9 is an explanatory view showing a second embodiment of the present invention.

In the image forming apparatus and the cartridge explained in the first embodiment, although the performance can be enhanced by using the memory means permitting the communication of various information data, in order to further improve performance (high quality image, high speed operation and the like), when the conventional printer or the cartridge is improved, alteration of the information to be written in the memory means is insufficient to achieve the improved performance, in some cases, the mechanisms or the members themselves must be altered. However, in such a case, the exchangeability to the conventional printers will be lost. The second embodiment can cope with this problem. Now, the second embodiment will be described with reference to FIGS. 9 and 10. Incidentally, the same elements as those in the aforementioned first embodiment are designated by the same reference numerals and explanation thereof will be omitted.

The drum cartridge 13 has a projection 62 formed on an upper front end (inserting direction) of the cartridge, and the printer H includes a cartridge insertion opening 47 having a notch 48 corresponding to the projection 62. Since the projection 62 is positioned at the front end and on the upper surface of the cartridge 13, the operator can ascertain the exchangeability before the cartridge is inserted into the printer. When the exchangeability cannot be kept, by deviating the projection 62 and the notch 48 to positions 62' and 48', respectively, the above object can be achieved. In this case, when the projection 62 is formed on a member (for example, the cover portion 56) other than the cartridge frame such as the container 14, the above object can be achieved only by changing the cover member, to thereby suppress "cost-up".

Figure 10:
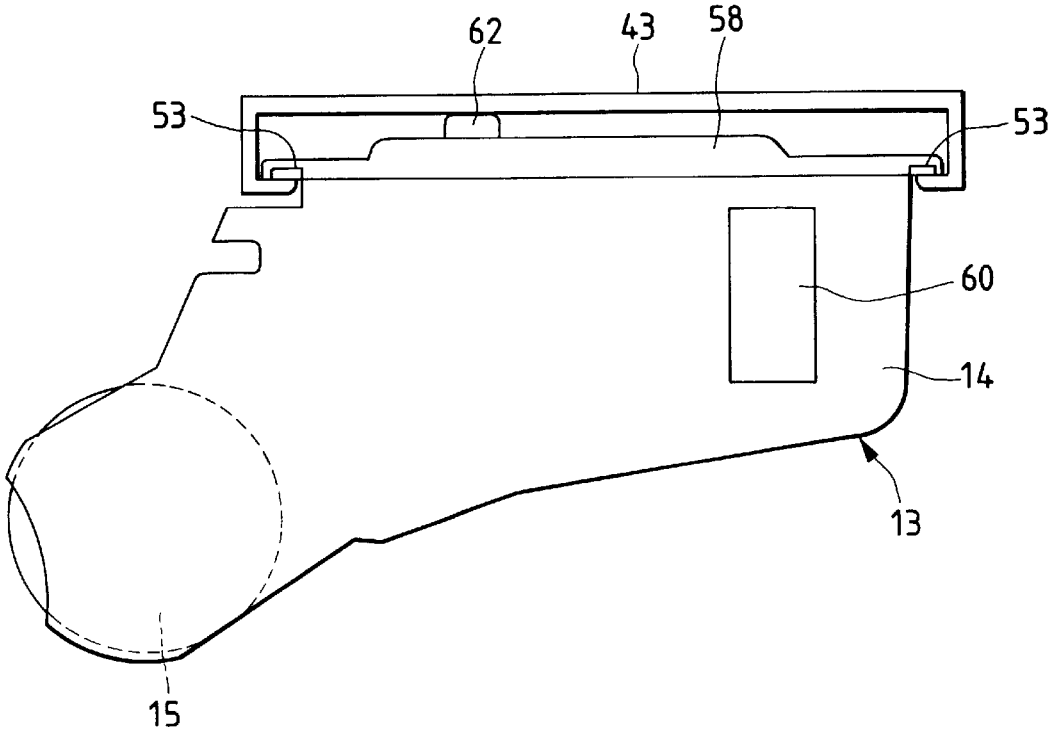
FIG. 10 is a schematic front view of the cartridge of FIG. 8.

Further, as shown in FIG. 10, when the projection 62 is disposed at a position where it is in proximity to the guide rail 43 of the printer when the cartridge 13 is mounted and dismounted with respect to the printer, the projection 62 has both an exchangeability ascertaining function and a shake preventing function.

As mentioned above, according to the present invention, there are provided a process cartridge in which a memory means of the process cartridge can surely be connected to an image forming apparatus stably and which has good operability and exchangeability, and an image forming apparatus having such a process cartridge.

What is claimed is:

1. A process cartridge detachably mountable to an image forming apparatus, comprising:

an electrophotographic photosensitive member;

process means acting on said electrophotographic photosensitive member;

a memory chip;

a connector for connecting said memory chip and a main body of said image forming apparatus when said cartridge is mounted on the main body; and a positioning mechanism for determining the posture of said cartridge when said cartridge is mounted on the main body;

wherein, when said cartridge is mounted on the main body, said connector is connected with a connector member of the main body after the posture of said cartridge is determined by said positioning mechanism.

2. A process cartridge according to claim 1, further comprising at least two positioning mechanisms provided at a front end face of the process cartridge in the inserting direction thereof into said image forming apparatus, and wherein, after at least said positioning mechanisms are connected to said image forming apparatus, said connector is connected to said connector member.

3. A process cartridge according to claim 2, wherein said connector is position on a line connecting between said two positioning mechanisms and is adjacent to one of said positioning mechanisms.

4. A process cartridge according to claim 1, wherein said connector has a first connection portion to be connected to said connector member of said image forming apparatus, a second connection portion to which said memory chip is to be attached, and an attachment surface for attaching said connector to a cartridge frame, and wherein said cartridge frame is provided with an attachment seat to which said connector is to be attached, and a projection wall for surrounding said second connection portion.

5. A process cartridge according to claim 4, wherein said second connection portion has a projection as a part thereof, and said protection wall has a notch corresponding to said projection.

6. A process cartridge according to claim 4, wherein said connector has a cover member for covering said connector other than said first connection portion, and an outer surface of said cover member is flush with or does not protrude from a tip end of said second connection portion.

7. A process cartridge according to claim 4, wherein said connector is supported for movement wit respect to said cartridge frame.

8. A process cartridge according to claim 1, wherein said memory chip comprises a connector member, said cartridge further comprising a regulate mechanism for regulating an axial position of the process cartridge in said image forming apparatus, and wherein said connector members are arranged to satisfy relations $X_{1t}>Y_{2t}$ and $X_{2t}<Y_{2b}$ and $X_{2b}<Y_{1t}$, when it is assumed that a minimum distance from the axial regulating position to an effective fitting tip of said connector member of said memory means is $X_{1t}$, a maximum distance from the axial regulating position to the effective fitting tip of said connector is $X_{2t}$, a minimum distance from the axial regulating position to an effective fitting root of said connector of said memory means is $X_{2b}$, a minimum distance from the exile regulating position to an effective fitting tip of said connector member of said image forming apparatus is $Y_{1t}$, a maximum distance from the axial regulating position to the effective fitting tip of said connector is $Y_{2t}$, and a minimum distance from the axial regulating position to an effective fitting root of said connector member of said image forming apparatus is $Y_{2b}$.

9. A process cartridge according to claim 1, further comprising a first grip portion provided on a longitudinal upper surface of the process cartridge and a second grip portion provided at a rear side of the process cartridge in the inserting direction of the process cartridge into said image forming apparatus.

10. A process cartridge according to claim 9, further comprising at least two recesses for engaging with an elastic member attached to a guide rail member provided on the main body of said image forming apparatus for suspending and guiding the process cartridge when the process cartridge is mounted on and dismounted from said image forming apparatus, and wherein one of said recesses is engaged by said elastic member at a position where the process cartridge is completely inserted into said image forming apparatus, and the other recess is engaged by said elastic member at a position where said first grip portion is exposed from said image forming apparatus.

11. A process cartridge according to claim 10, wherein an interface between members forming the process cartridge is formed as a rib to be suspended from said guide rail member.

12. A process cartridge according to claim 10, further comprising a projection formed on a front portion of the process cartridge in the inserting direction thereof into said image forming apparatus to be fitted into a notch formed in a cartridge insertion opening formed on the main body of said image forming apparatus.

13. A process cartridge according to claim 12, wherein said projection is formed at a position to be in proximity to said guide rail member when the process cartridge is mounted on and dismounted from said image forming apparatus.

14. A process cartridge according to any one claims 1 to 13, wherein the process cartridge integrally incorporates therein said electrophotographic photosensitive member, and charge means, developing means, or cleaning means as said process means, as a cartridge unit which can detachably be mounted on said image forming apparatus.

15. A process cartridge according to any one of claims 1 to 13, wherein the process cartridge integrally incorporates therein said electrophotographic photosensitive member, and at least one of charge means, developing means, and cleaning means as said process means, as a cartridge unit which can detachably be mounted on said image forming apparatus.

16. A process cartridge according to any one of claims 1 to 13, wherein the process cartridge integrally incorporates therein said electrophotographic photosensitive member, and at least developing means as said process means, as a cartridge unit which can detachably be mounted on said image forming apparatus.

17. An image forming apparatus comprising:

image forming means for forming an image on a recording medium; and a process cartridge detachably mounted on said image forming apparatus, said process cartridge comprising:

an electrophotographic photosensitive member;

process means acting on said electrophotographic photosensitive member;

a memory chip;

a connector for connecting said memory chip and a main body of said image forming apparatus when said cartridge is mounted on the main body; and a positioning mechanism for determining the posture of said cartridge when said cartridge is mounted on the main body;

wherein, when said cartridge is mounted on the main body, said connector is connected with a connector member of the main body after the posture of said cartridge is determined by said positioning mechanism.

* * * * *

UNITED STATES PATENT AND TRADEMARK OFFICE

CERTIFICATE OF CORRECTION

PATENT NO. : 5,963,759

DATED : October 5, 1999

INVENTOR(S) : Hisayoshi KOJIMA et al.

It is certified that error appears in the above-identified patent and that said Letters Patent is hereby corrected as shown below:

ON THE COVER PAGE:

Item [56], References Cited, FOREIGN PATENT DOCUMENTS:

"06067484" should read --6-067484--.

COLUMN 1:

Line 29, "An" should read --an--.
Line 50, "on" should be deleted.

COLUMN 2:

Line 5, "sheets can" should read --sheets.--.
Line 6, "be printed." should be deleted.
Line 56, "cleaner 104C" should read -- cleaner 104c--.

UNITED STATES PATENT AND TRADEMARK OFFICE

CERTIFICATE OF CORRECTION

PATENT NO. : 5,963,759

DATED : October 5, 1999

INVENTOR(S) : Hisayoshi KOJIMA et al.

It is certified that error appears in the above-identified patent and that said Letters Patent is hereby corrected as shown below:

COLUMN 3:

Line 3, "were" should read --are--.
Line 38, "to" should read --for--.

COLUMN 5:

Line 34, "contact charging" should read --a contact-charging--.

COLUMN 6:

Line 49, "aluminium" should read --aluminum--.
Line 52, "aluminium" should read --aluminum--.

COLUMN 8:

Line 62, "does" should read --is--.
Line 63, "is" should read --does--.

UNITED STATES PATENT AND TRADEMARK OFFICE

CERTIFICATE OF CORRECTION

PATENT NO. : 5,963,759

DATED : October 5, 1999

INVENTOR(S) : Hisayoshi KOJIMA et al.

It is certified that error appears in the above-identified patent and that said Letters Patent is hereby corrected as shown below:

COLUMN 11:

Line 29, "position" should read --positioned--.
Line 43, "protection" should read --projection--.
Line 51, "wit" should read --with--.
Line 66, "exile" should read --axial--.

COLUMN 12:

Line 39, "one" should read --one of--.

Signed and Sealed this

Twelfth Day of December, 2000

*Attest:*

Q. TODD DICKINSON

*Attesting Officer*

*Director of Patents and Trademarks*